US012674311B1

(12) United States Patent
Rudge

(10) Patent No.: US 12,674,311 B1
(45) **Date of Patent: *Jul. 7, 2026**

(54) CONNECTOR WITH A RECEIVING FIN

(71) Applicant: Pauline Nicola Rudge, Glen Ellen, CA (US)

(72) Inventor: Pauline Nicola Rudge, Glen Ellen, CA (US)

( * ) Notice: Subject to any disclaimer, the term of this patent is extended or adjusted under 35 U.S.C. 154(b) by 102 days.

This patent is subject to a terminal disclaimer.

(21) Appl. No.: 18/427,397

(22) Filed: Jan. 30, 2024

Related U.S. Application Data

(63) Continuation-in-part of application No. 18/533,494, filed on Dec. 8, 2023.

(51) Int. Cl.
*E04B 1/18* (2006.01)
*E04B 1/19* (2006.01)

(52) U.S. Cl.
CPC ..... *E04B 1/185* (2013.01); *E04B 2001/1957* (2013.01)

(58) Field of Classification Search
CPC ..... E04B 1/388; E04B 1/2604; E04B 1/5831; E04B 2001/2616; E04B 2001/266; E04B 2001/5868; E04B 1/185; E04B 2001/1957
See application file for complete search history.

(56) References Cited

U.S. PATENT DOCUMENTS 3,495,857 A 2/1970 Hawke et al.
4,398,841 A 8/1983 Kojima et al.
4,885,883 A 12/1989 Wright
4,910,939 A 3/1990 Cavanagh
5,435,110 A 7/1995 Stol et al.
7,883,296 B2 * 2/2011 Meyer ..... E02D 17/04 405/283

(Continued)

FOREIGN PATENT DOCUMENTS

DE 2453917 A1 5/1976
EP 0591127 A1 4/1994

(Continued)

OTHER PUBLICATIONS

Written Opinion of International Searching Authority dated Feb. 5, 2025, for PCT/US2024/058835.

*Primary Examiner* — Rodney Mintz
(74) *Attorney, Agent, or Firm* — Jacob M. Ward; Ward Law Office LLC

(57) ABSTRACT

The disclosed invention is a connector that enhances the construction of structures by enabling the connection of boards to sheets of material with improved precision and stability. The connector's body is equipped with an integrated guide that aligns with the edge of a sheet for accurate placement. Multiple sockets in the body, each facing different directions, are designed to receive the ends of boards. A key feature is a sheet slot that allows the sheet to directly contact the board, reinforcing the structural integrity of the assembly and substantially eliminating gaps between the boards and sheets. The connector can be manufactured as a single part or in multiple parts for assembly flexibility and may be made from sustainable materials. It is suitable for structures requiring easy assembly and disassembly, and can be provided as a kit with corresponding boards and sheets.

19 Claims, 9 Drawing Sheets

(56) References Cited

U.S. PATENT DOCUMENTS

| | | | | |
|---|---|---|---|---|
| 8,627,632 | B2 * | 1/2014 | Werner | B21C 23/10 52/653.1 |
| 11,174,630 | B2 * | 11/2021 | Bowron | E04B 1/2604 |
| 11,828,056 | B2 | 11/2023 | Styrc et al. | |
| 2006/0193687 | A1 * | 8/2006 | Ghosh | E04B 1/2604 403/401 |
| 2010/0054869 | A1 * | 3/2010 | Meyer | E02D 17/04 405/282 |
| 2011/0286121 | A1 | 11/2011 | Werner et al. | |
| 2018/0135295 | A1 * | 5/2018 | Bowron | E04B 1/2604 |
| 2022/0034079 | A1 * | 2/2022 | Styrc | E04B 1/0046 |
| 2025/0188736 | A1 * | 6/2025 | Rudge | E04B 1/5831 |

FOREIGN PATENT DOCUMENTS

| | | | |
|---|---|---|---|
| EP | 1395714 | A1 | 3/2004 |
| EP | 1511668 | A1 | 3/2005 |
| EP | 1896669 | A1 | 3/2008 |
| EP | 3585209 | A1 | 1/2020 |
| FR | 2470892 | A1 | 6/1981 |
| GB | 871309 | A | 6/1961 |
| GB | 910183 | A | 11/1962 |
| GB | 2118587 | A | 11/1983 |
| GB | 2182112 | A | 5/1987 |
| GB | 8523360 | A | 5/1987 |
| GB | 8706830 | A | 9/1988 |
| GB | 9018315 | A | 4/1992 |
| GB | 9609087 | A | 11/1997 |
| GB | 9901076 | A | 3/2000 |
| GB | 2395207 | A | 5/2004 |
| GB | 201413531 | A | 4/2016 |
| GB | 2619138 | A | 11/2023 |
| KR | 20130134591 | A | 12/2013 |
| KR | 20130134691 | A | 12/2013 |
| WO | 2002095153 | A1 | 11/2002 |
| WO | 2004013426 | A1 | 2/2004 |
| WO | 2006078642 | A2 | 7/2006 |
| WO | 2016178637 | A1 | 11/2016 |
| WO | 2018152624 | A | 8/2018 |

* cited by examiner

CONNECTOR WITH A RECEIVING FIN

CROSS REFERENCE TO RELATED APPLICATIONS

This application is a Continuation-in-Part of U.S. Utility patent application Ser. No. 18/533,494, filed on Dec. 8, 2023, and incorporated herein by reference.

STATEMENT REGARDING FEDERALLY SPONSORED RESEARCH AND DEVELOPMENT

Not Applicable.

FIELD OF THE INVENTION

The present invention relates to a connector or a set of connectors that together are used to form modular frames, in particular a connector or a connector system for connecting elongate members such as boards of material; more particularly but not exclusively battens, lengths or boards of timber, synthetic plastics, recycled material such as plastic lumber, or metal.

BACKGROUND

The construction of temporary or permanent structures often involves the assembly of large frameworks composed of rigid members, such as lengths of timber or other elongate materials. Traditional methods of joining these materials can be cumbersome, involving joints that are either too complex-require a lot of tools and significant skill to assemble, do not grip materials or hold a defined angle, and often result in a structure that is difficult to assemble and require more than one person to assemble. Additionally, these joints may be single-use, prone to damage upon disassembly, and do not always allow for the direct contact between the sheets and boards, which is crucial for structural integrity.

Existing connectors, such as those disclosed in prior art references GB 2014 13 531 (JOHNSON), GB 8 523 360 (WATTS), GB 8 71 309 (LEAPMAN), FR2470892 (GUILLAUDMOND), and WO02/095153 (DU PREEZ), offer various solutions for connecting elongate members. However, these solutions often do not address the need for a more efficient, durable, and reusable joint that allows for the direct contact between connected materials. The ability for sheets and boards to make direct contact within a joint is essential for creating a stable and secure connection, without gaps, which is particularly important in temporary structures that may be subject to movement, reconfiguration, or environmental factors such as maintaining a dry, insulated, breezeless environment within the structure that can be sealed.

There is a need for an improved connector that simplifies the process of assembling structures by providing a secure and reusable connection between elongate members or boards and sheets of material. Such a connector should allow for the direct contact between the sheets and boards, enhancing the overall stability and integrity of the structure. It should also be easy to assemble and disassemble without causing damage to the components, thereby extending the usability of the materials and the connector itself. Such a needed connector would expand opportunities for those less skilled or less-abled by requiring fewer skills and tools to use. The present invention fulfills these needs.

SUMMARY OF THE INVENTION

The invention is a connector or a connector system with multiple types of connectors that simplifies the construction of structures by facilitating the connection of boards to sheets of material. The connector includes a body with an integrated guide that precisely aligns with the edge of a sheet when inserted. This guide is designed to ensure accurate placement of the sheet in relation to the body. The body also houses multiple sockets, each possibly facing a different direction to accommodate the ends of boards.

To secure the boards and prevent their movement within the sockets, the walls of the sockets are fitted with fastener receivers that include a recessed area and an aperture for the insertion of mechanical fasteners. Furthermore, the connector may include ribs along the inner surface of the sockets to ensure a tight fit for the boards. Such sockets may be equipped with tool slots along their walls, which allow for the use of a tool to aid in the insertion and removal of the boards. A notable feature of the connector is a sheet slot that cuts across the body, aligning with the guide to enable the sheet to contact the board directly, thus enhancing the structural integrity of the assembled framework.

The guide may comprise parallel sections that create channels to hold the edge of a sheet, with the sheet slot located between these sections for additional support. The guide May also have holes designed to receive fasteners that secure the sheet to the connector.

The connector is designed for ease of manufacturing and can be produced as a single part or as two or more separate parts, providing greater flexibility during assembly. The body can be made by using sustainable materials such as synthetic or recycled plastics, such as with an injection molding process, or by utilizing sheet metal materials such as sheet steel. The sockets are capable of projecting at various angles from the body, allowing for different structural designs. The inclusion of stopper plates or ridges is an additional feature to ensure the correct positioning of the boards within the sockets.

The invention can be offered as a kit that includes the connectors, along with the corresponding boards and sheets. The kit may also contain boards with a longitudinal groove that matches the sheet slot of the connector for a secure and precise fit. The connector is versatile and particularly suitable for temporary structures that require easy assembly and disassembly. Additional features such as internal ribs, fastener receivers and guide holes, and the ability to construct insulated walls with multiple channels for various sheets of material can be incorporated into the design to enhance its functionality.

The present invention provides a connector that not only facilitates the easy assembly and disassembly of structures but also ensures the direct contact between sheets and boards. This direct contact is achieved through a novel design that includes a sheet slot traversing the connector body, aligning with the guide for the sheet material, and allowing for a seamless and secure connection. The invention represents a significant improvement over existing connectors, offering a practical solution for the construction of temporary and/or more permanent modular structures. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
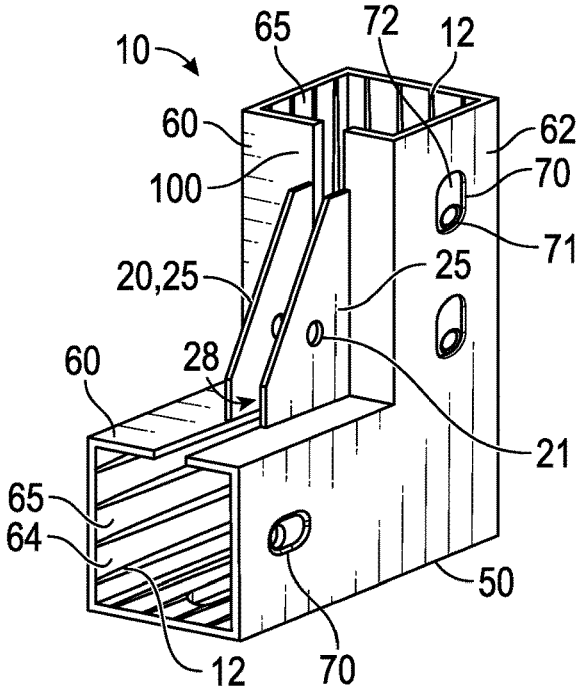
FIG. 1 is a perspective view of a first embodiment of the invention.
Figure 2:
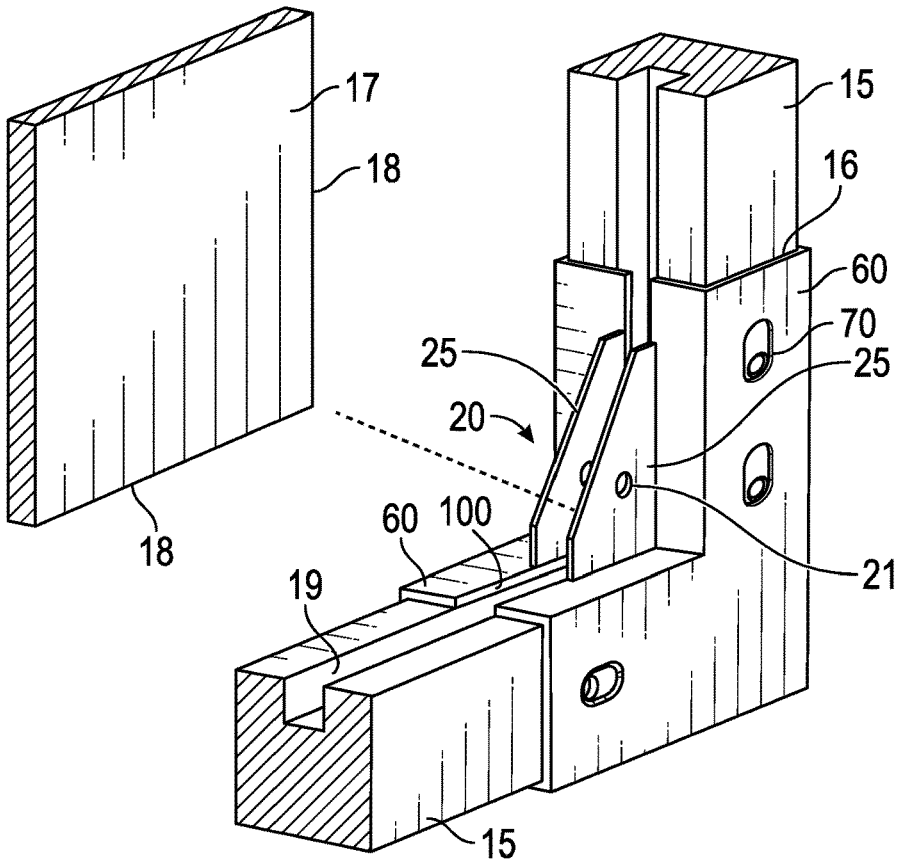
FIG. 2 is a perspective view of the first embodiment showing two elongated boards engaged with sockets of a body of the invention.
Figure 3:
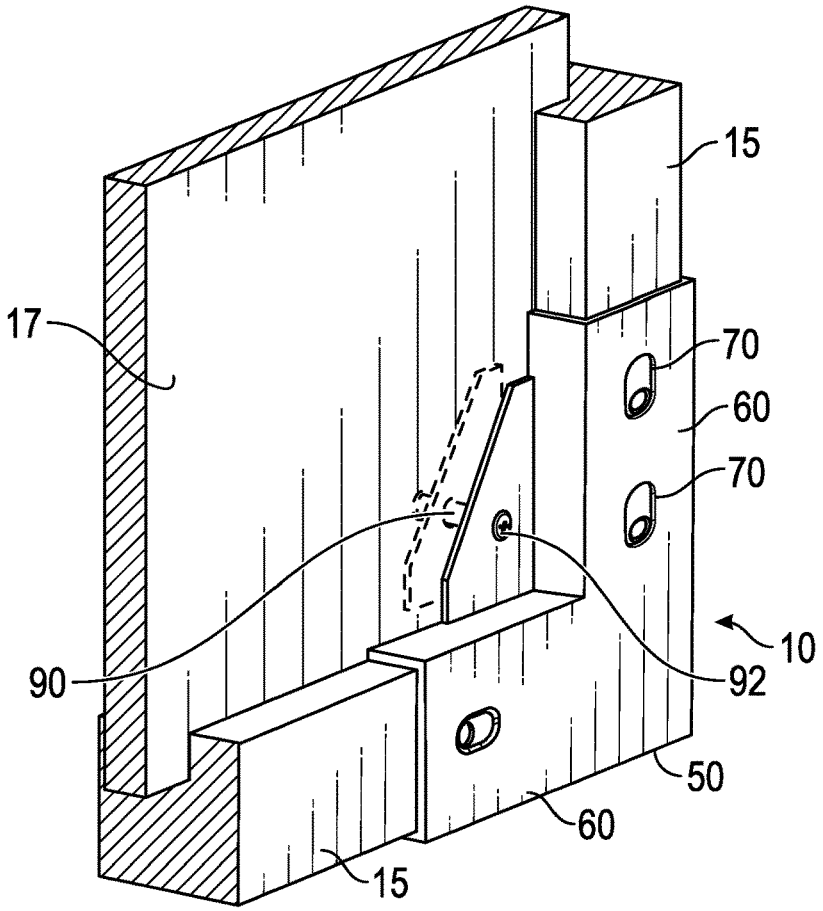
FIG. 3 is a perspective view of the first embodiment further showing a sheet material fixed between two guides of the invention.

FIGS. 1-3 illustrate a connector 10 designed to facilitate the assembly of structures by connecting at least one elongated board 15 with at least one sheet 17. The connector 10 includes a body 50 equipped with at least one guide 20 for receiving an edge 18 of the sheet 17. This guide 20 is integral to the body 50 and is strategically positioned to align with the edge 18 of the sheet 17 when inserted.

The connector 10 further comprises at least two sockets 60, each with an opening 65 designed to receive an end 16 of the board 15. These sockets 60 are oriented such that each opening 65 faces a different direction, allowing for versatile assembly options. To facilitate the removal of the board 15 within the sockets 60, at least one tool slot 80 (FIGS. 6 and 10) that extends axially along a wall 62 of one or more of the sockets 60 may be included. This slot 80 permits the insertion of a tool (not shown), such as a screwdriver or pick, to engage with the board 15 (FIG. 5), aiding in its placement and removal.

Additionally, each socket 60 includes at least one hole 71 through its wall 62 for the insertion of a mechanical fastener 90, such as a threaded screw, nail, 4-hex head fastener, or the like. A fastener receiver 70 is preferably included that comprises the hole 71 (FIG. 1) and a recessed area 72 for receiving a head 92 (FIG. 3) of a fastener 90, such that the head 92 of the fastener 90 is flush with the socket 60 when fully engaged with the board 15. The fastener 90 serves to prevent axial movement of the board 15 with respect to the socket 60 when engaged with the socket 60, ensuring a stable and secure mechanical connection.

A novel feature of the connector 10 is the inclusion of at least one sheet slot 100 that traverses the body 50 and aligns with the at least one guide 20. This sheet slot 100 allows the sheet 17 to make direct contact with the board 15, enhancing the structural integrity of the assembled framework and substantially eliminating gaps between the board 15 and the sheet 17.

The at least one guide 20 preferably comprises at least two parallel guide sections 25 that define one or more channels 28 for holding the edge 18 of a sheet 17. The sheet slot 100 traverses the body 50 between each guide section 25, providing additional support and alignment for the sheet 17.

In some embodiments, the at least one guide 20 may feature at least one aperture 21 for receiving one of the mechanical fasteners 90 therethrough. This allows for the secure attachment of the sheet 17 to the connector 10, further enhancing the stability of the assembled structure. The fastener 90 used to secure the sheet 17 are likely shorter than fasteners 90 used to secure the boards 15 within the sockets 60.

The connector 10 may also include at least one rib 12 extending axially along an inner surface 64 of at least one of the at least two sockets 60. These ribs 12 provide additional grip and support for the board 15, ensuring a tight fit within the socket 60. Such ribs 12 may also be tapered, having a varying height along its length, for providing a gradual increase in the frictional force of the board 15 within the socket 60. Each socket 60 may have an opening 65 that is tapered to facilitate the insertion of the board 15.

Figure 17:
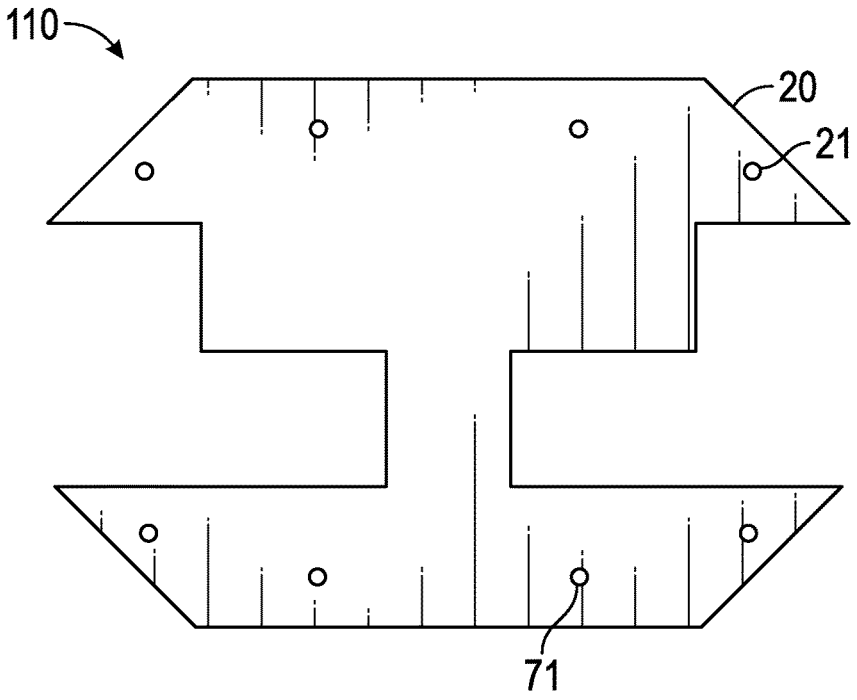
FIG. 17 is a top plan view of an embodiment of the connector formed from a sheet metal material and still in a flat configuration.
Figure 18:
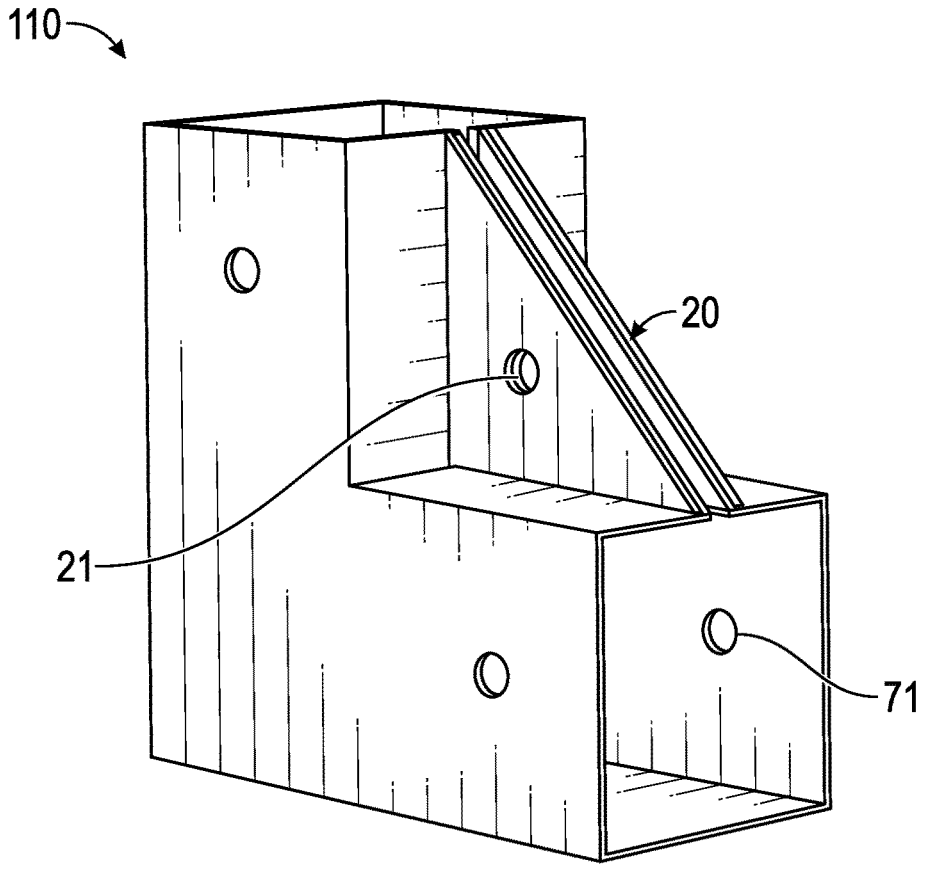
FIG. 18 is a perspective view of the embodiment of FIG. 17 in a fully formed configuration.

The connector 10 may be formed as a single part (FIGS. 1-3) for ease of manufacturing and assembly, and may be formed from a synthetic plastics or a recycled synthetic plastics, contributing to environmental sustainability. The connector 10 may also be formed as two or more parts (FIGS. 4, 5, 6, and 15), each part mutually separated at the at least one sheet slot 100, allowing for additional flexibility in assembly. Alternately the connector 10 is made from a formed sheet metal material (FIGS. 17 and 18), such as steel, that can be stamped out of a sheet metal material (FIG. 17) and bent into the proper shape (FIG. 18).

Figure 16:
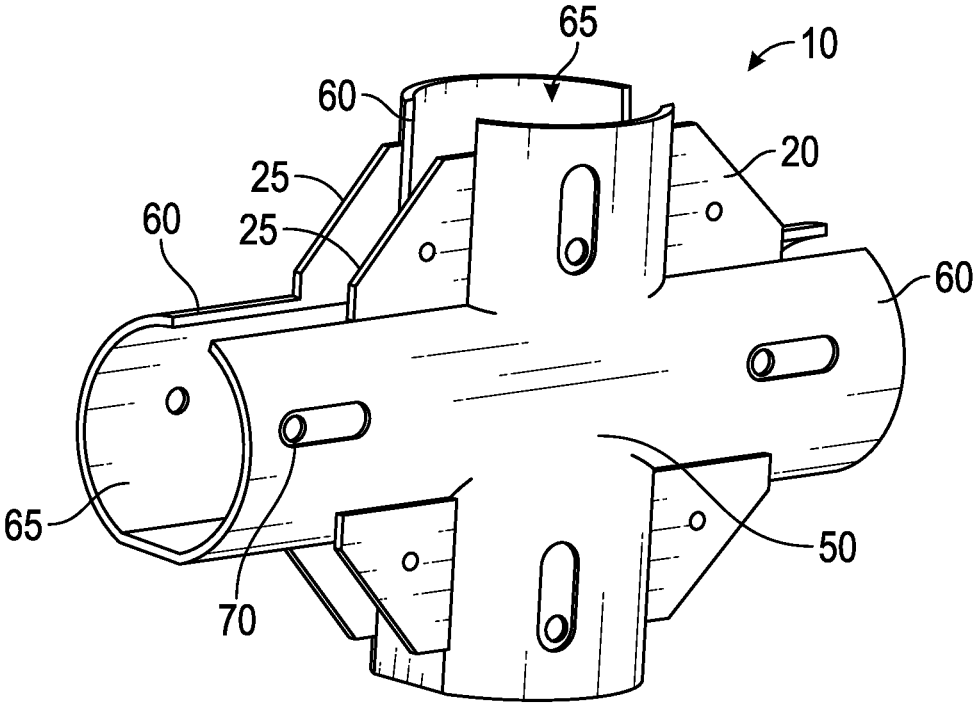
FIG. 16 is a side perspective view of a twelfth embodiment of the invention.

The sockets 60 of the connector 10 may project at different angles from the body 50, allowing for the creation of various structural configurations. The sectional profile of each of the at least two sockets 60 may be rectangular (FIG. 6), square (FIGS. 1-5), circular, semi-circular (FIG. 16), oval, hexagonal, or other shape depending on design requirements and the type of boards 15 available. FIG. 16 shows a single piece connector 10, however such a connector could also be split between all of the guides 20 as shown with other embodiments. The board 20 used with such an embodiment is generally circular but for a flat lower side and a grooved upper side.

To limit the entry of the board 15 into the socket 60, each of the at least two sockets 60 or the body 50 may include a stopper plate or a stopper ridge (not shown). This feature ensures that the board 15 is positioned correctly within the socket 60 and does not pass through it into an adjacent socket 60.

A kit of parts (not shown) may be provided, including at least two connectors 10, at least one of the boards 15, and at least one of the sheets 17. Such a kit may also include boards 15 with at least one longitudinal groove 19 (FIGS. 2 and 5) formed therein that corresponds with the sheet slot 100 of the connector 10, ensuring a precise and secure fit with no gaps between the sheet 17 and the board 15. The longitudinal groove 19 may be cut at an angle when the connector 10 includes sockets 60 at disparate angles (FIG. 12-15).

The elongated board 15 may be made from a variety of materials, such as battens, lengths of timber, synthetic plastics, recycled material such as plastic lumber, mixed polymers, carbon fiber materials, or metal (not shown). The board 15 may be a typical wood 1"×2" or 2"×4" stud, or other shape as desired. These materials can be used to form modular frames, particularly suitable for temporary structures that provide relatively easy assembly and disassembly.

Another optional feature is the inclusion of internal ribs 12 to locate and fix the end 16 of the board 15 in the socket 60. These ribs 12 can be strategically placed on all or some of the walls that form the socket 60, potentially extending to the body 50 of the connector 10, to provide a secure fit and prevent movement of the boards 15 when engaged with the socket 60.

The provision of the holes 71 and apertures 21 for securing the boards 15 and sheets 17 to the connector 10 is also an optional feature. These holes 71 and apertures 21 can be positioned to allow for the easy insertion of the mechanical fasteners 90, such as screws, nails, locking keys, or the like, to further secure the boards 15 and the sheets 17 to the connector 10. The channels 28 can be made of any width to accommodate the sheets 17 having varying widths and depths.

Figure 11:
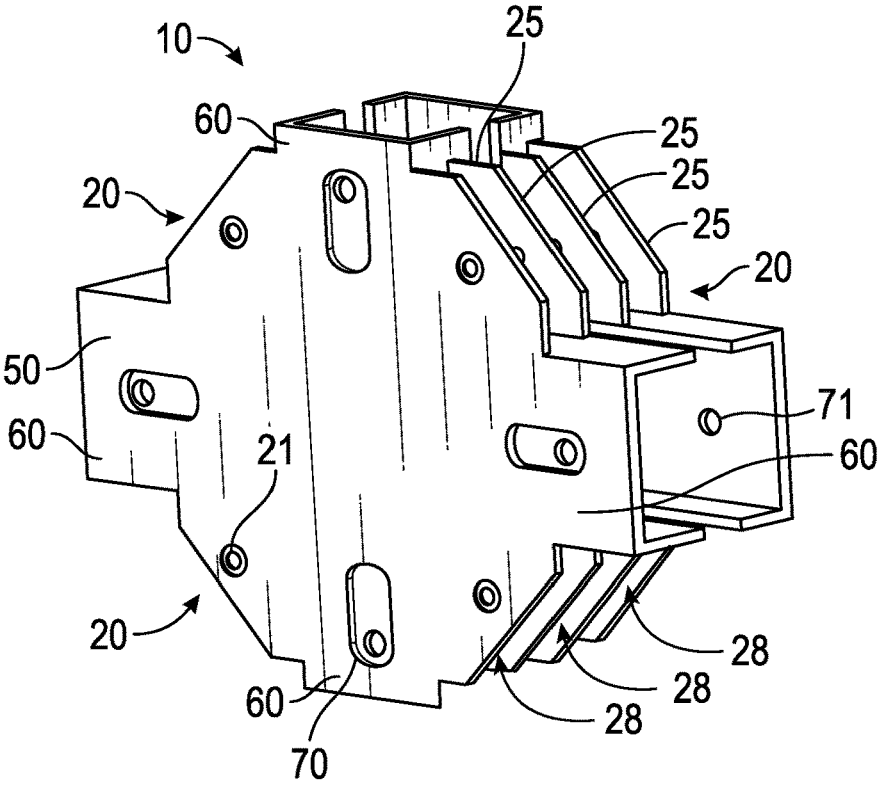
FIG. 11 is a side perspective view of an eighth embodiment of the invention.

The ability to form insulated walls with multiple channels 28 for separate diverse sheets 17 is an additional feature that can be integrated into the connector design, as illustrated in FIG. 11. This allows for the construction of walls with insulation layers, for example, enhancing the functionality of the assembled structure.

Figure 4:
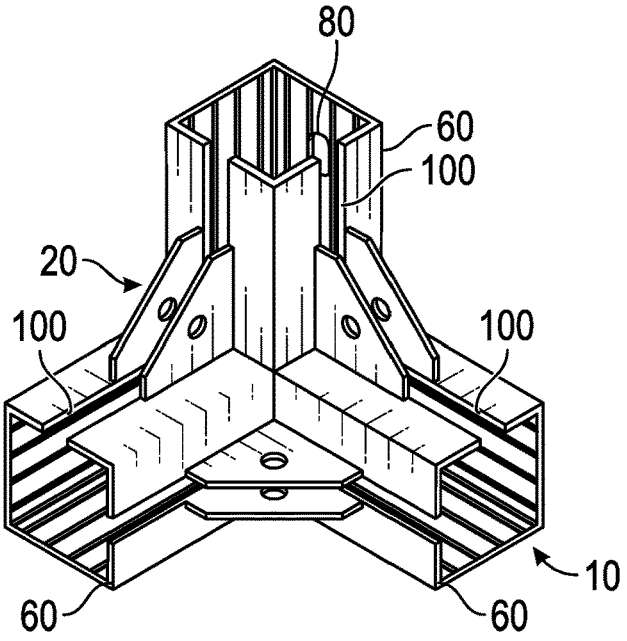
FIG. 4 is a perspective view of a second embodiment of the invention, illustrating three of the sockets each opening in different orthogonal directions.
Figure 5:
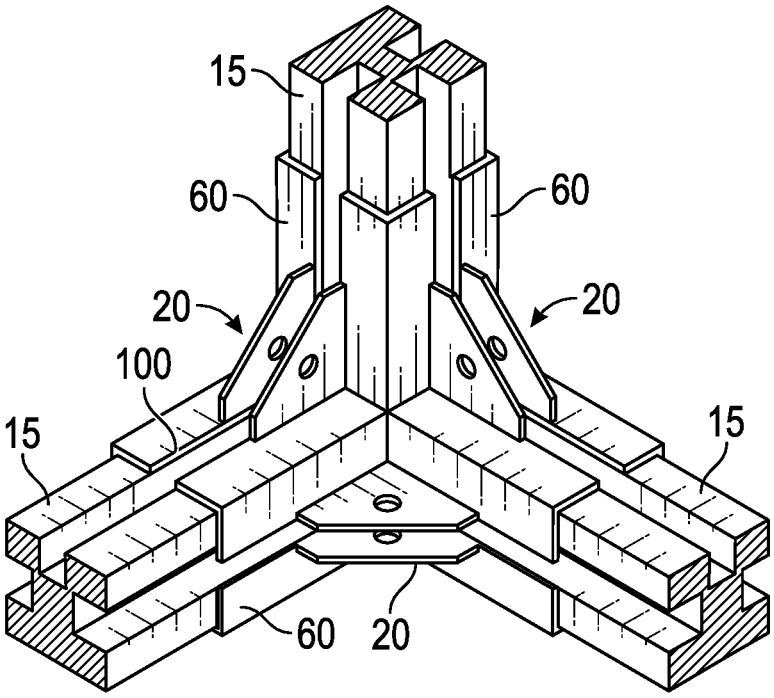
FIG. 5 is a perspective view of the second embodiment, illustrated with three elongated boards engaged with sockets of the body of the invention.
Figure 6:
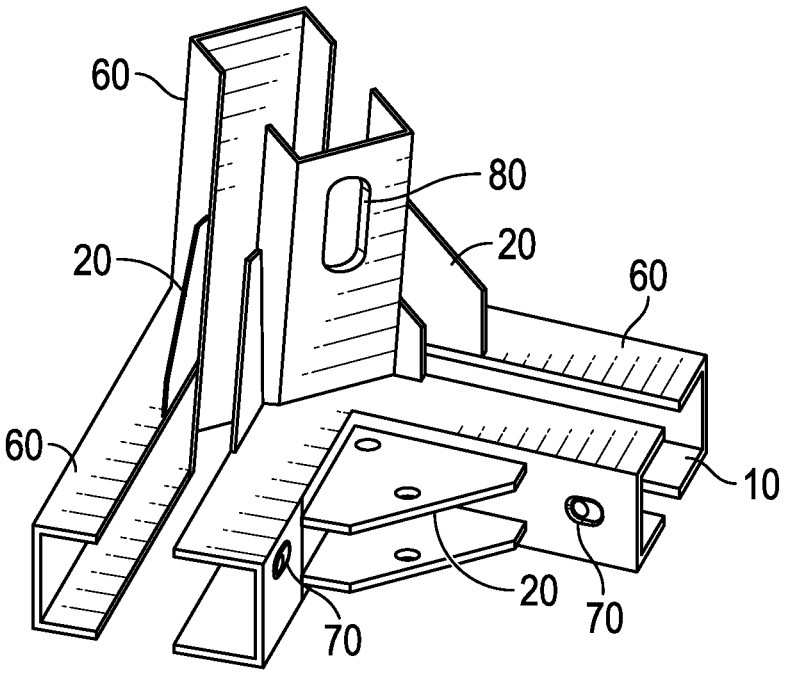
FIG. 6 is a perspective view of a third embodiment of the invention.
Figure 7:
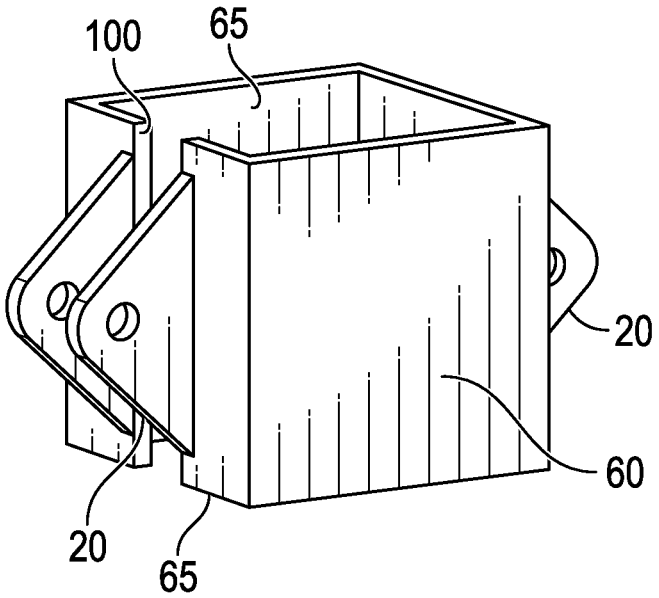
FIG. 7 is a perspective view of a fourth embodiment of the invention.
Figure 8:
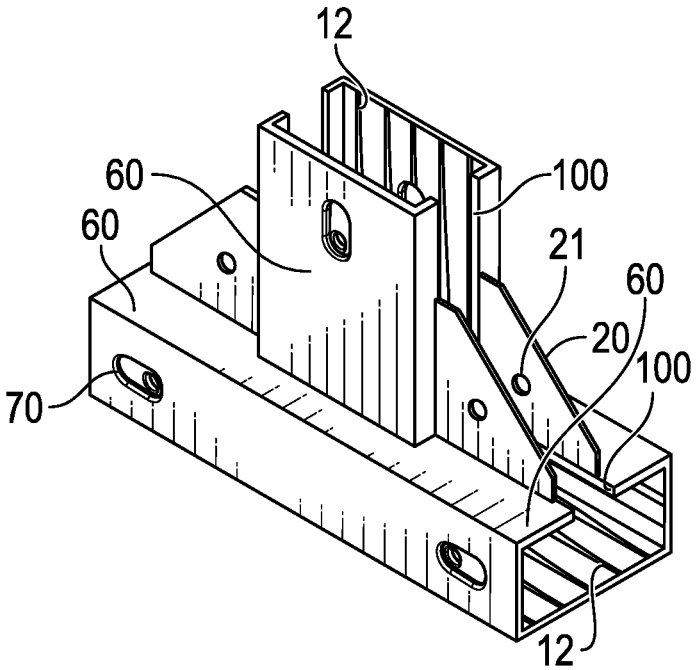
FIG. 8 is a side perspective view of a sixth embodiment of the invention.
Figure 9:
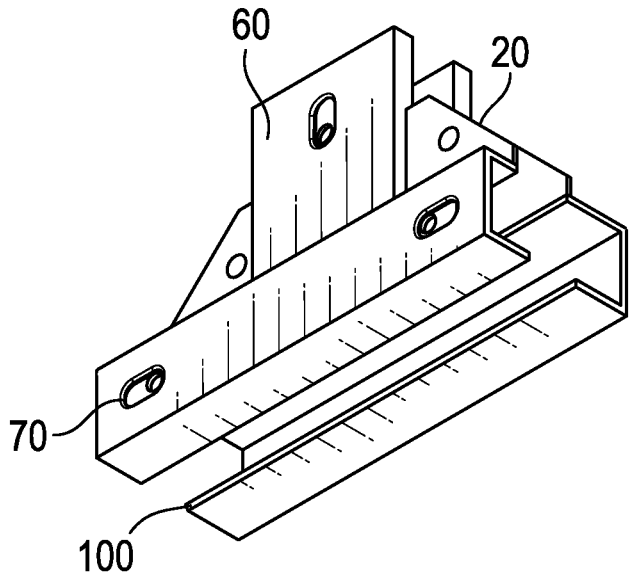
FIG. 9 is a bottom perspective view of a fifth embodiment of the invention.
Figure 10:
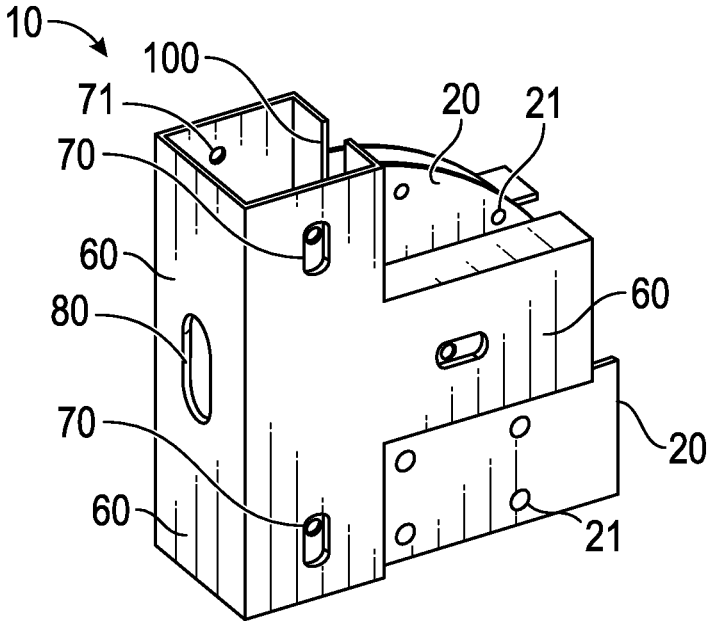
FIG. 10 is a side perspective view of a seventh embodiment of the invention.
Figure 12:
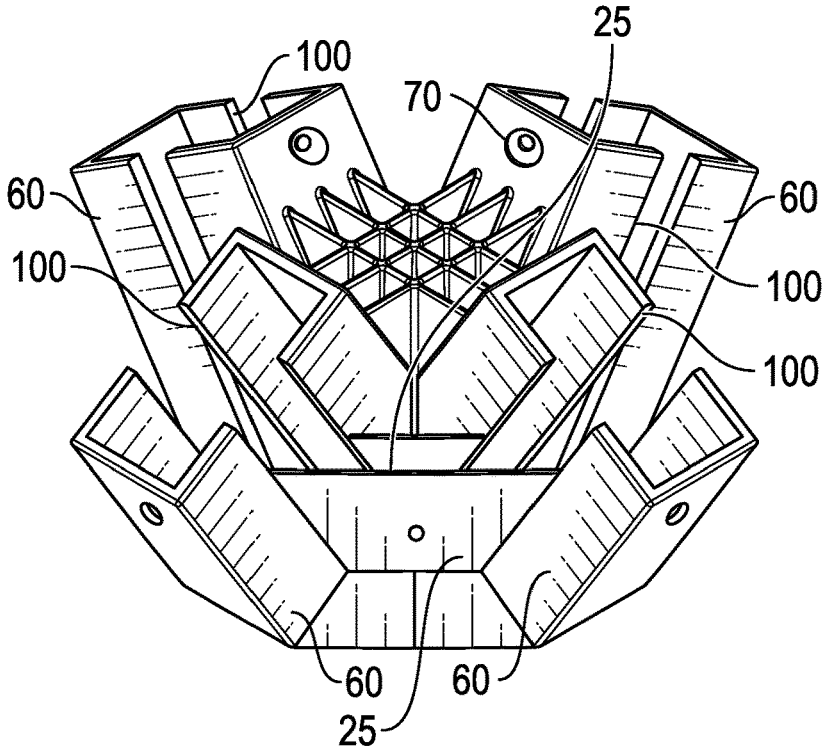
FIG. 12 is a top perspective view of a ninth embodiment of the invention.
Figure 13:
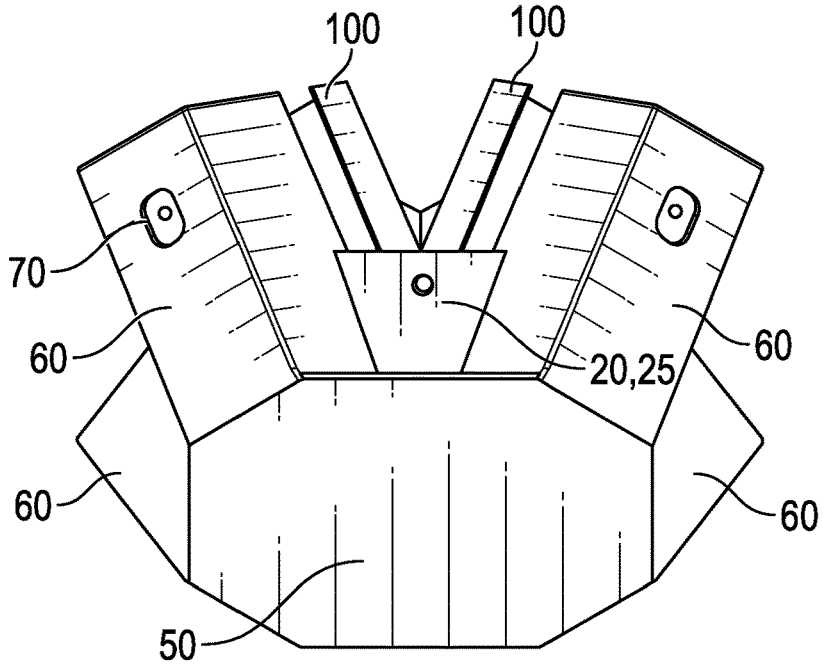
FIG. 13 is a bottom perspective view of the ninth embodiment of the invention.
Figure 14:
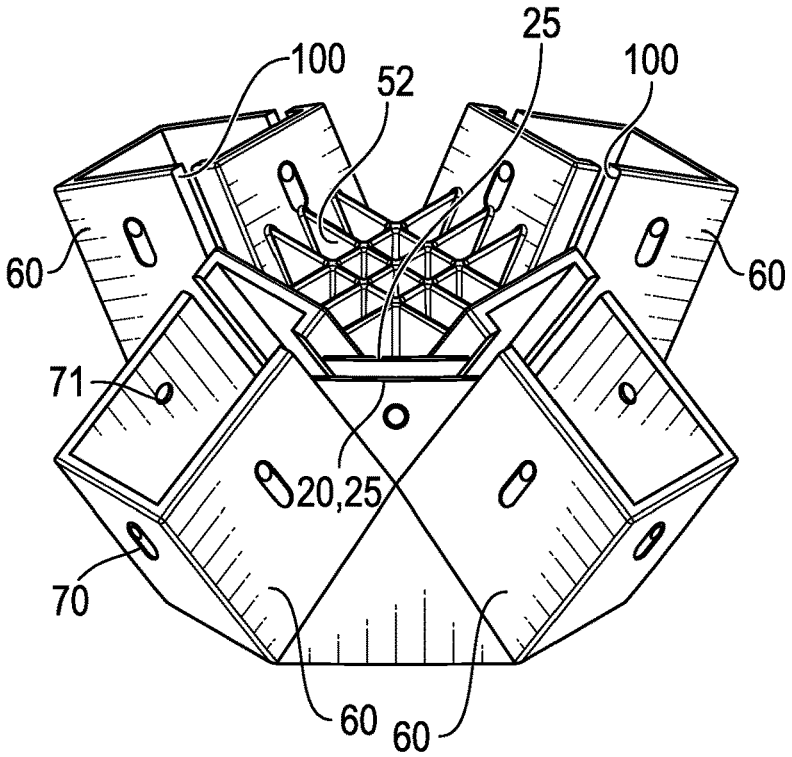
FIG. 14 is a top perspective view of a tenth embodiment of the invention.
Figure 15:
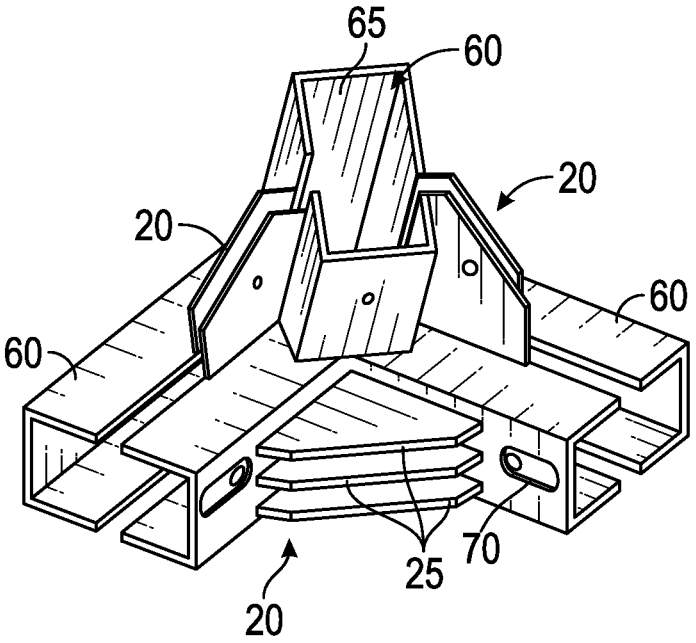
FIG. 15 is a top perspective view of an eleventh embodiment of the invention.

In the drawings, FIGS. 1-3 illustrate an L-type connector 10, showing the steps of assembly from inserting the boards 15 into the sockets 60, and then the sheet 17 into the sheet slots 100. FIGS. 4-5 are perspective views of a corner type connector 10, illustrating three of the sockets 60 each opening in different orthogonal directions. FIG. 6 is a perspective view of an alternate embodiment of a corner connector 10 with larger guides 20 for thicker sheets 17. FIG. 7 is a perspective view of a connector 10 shown here connecting to one board 15 with one or two sheets 17, such a connector 10 having only one of the sockets 60 but allowing the board 15 to pass through the connector 10 if desired. Such a connector 10 may FIGS. 8 and 9 are perspective views of a T-type embodiment of the connector 10 that accepts rectangular boards 15, such as wood 1"×2" or 2"×4" boards. Such a connector 10 can be made as either a single piece (FIG. 8) or as two cooperating pieces (FIG. 9). FIG. 10 is a side perspective view of another T-type connector 10 that shows differing shapes of guides 20, and for use with boards 15 having a square cross-section. FIG. 11 is a side perspective view of an embodiment wherein the guides 20 include multiple guide sections 25 for allowing multiple sheets 17 to be connected in parallel. Such multiple sheets 17 may all have different characteristics for strength, sound absorption, thermal insulation, and the like. For example, such sheets 17 can be plywood, siding such as wood, polycarbonate, mesh, plexiglass, plywood, wire mesh, pig wire, insulating panels, foam panels, or the like. FIGS. 12-14 are perspective views of a tent base or topper type connector 10 for resting on a ground surface (not shown), or topping-out a structure (not shown). Strengthening ribs 52 (FIG. 14) may be included to further support the sockets 60 and boards 15 engaged therewith when in use. FIG. 15 is a top perspective view of an alternate embodiment of a corner connector 10 wherein one of the guides 20 includes three of the guide sections 25 for allowing two different types of sheets 17 to be mounted together and in parallel. FIG. 16 is a side perspective view of an embodiment of the connector 10 that accepts boards 15 having semi-circular cross-sections. FIG. 17 shows an embodiment made of stamped sheet metal, still in a flat configuration, while FIG. 18 shows this embodiment folded into its final form as the connector 10. With embodiments made of steel or folded sheet material, the fastener receiver 70 preferably includes only the hole 71 and not the recessed area 72.

While a particular form of the invention has been illustrated and described, it will be apparent that various modifications can be made without departing from the spirit and scope of the invention. For example, the guide sections 25 may extend beyond the sockets 60 (FIG. 10), or not, as illustrated in the other figures. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A connector for connecting at least one elongated board with at least one sheet, the connector consisting of:

a body having at least one guide projecting outwardly therefrom configured to receive an edge of the sheet;

at least two sockets extending outwardly from the body, each socket having an opening configured to receive an end of the board, each socket opening in a different direction, and at least one hole extending through a wall of each socket configured to receive a mechanical fastener that prevents axial movement of the board with respect to the socket; and at least one sheet slot centrally located in the body configured to receive the edge of the sheet, the sheet slot being aligned with the at least one guide and traversing an entire length of the body such that the at least one sheet directly contacts the at least one board.

2. A connector for connecting at least one elongated board of material with at least one sheet of material, the connector comprising:

a body with at least one guide projecting outwardly therefrom configured to receive an edge of the sheet; and at least two sockets extending outwardly from the body, each socket having an opening configured to receive an end of the board, each socket opening in a different direction and having at least one rib extending axially along an inner surface thereof, and at least one hole extending through a wall of each socket configured to receive a mechanical fastener that prevents axial movement of the board with respect to the socket;

wherein the body includes at least one sheet slot centrally located therein configured to receive the edge of the sheet, the sheet slot being aligned with the at least one guide and traversing an entire length of the body such that the at least one sheet directly contacts the at least one board.

3. The connector according to claim 2 wherein the at least one guide is at least two parallel guide sections that define one or more channels for holding the edge of the at least one sheet of material, the sheet slot traversing the body between each guide section.

4. The connector according to claim 2 wherein the at least one guide has at least one aperture for receiving the mechanical fastener therethrough to secure the sheet with the connector.

5. The connector according to claim 2 formed as a single part.

6. The connector according to claim 2 formed from a synthetic plastics or a recycled synthetic plastics.

7. The connector according to claim 2 wherein the at least two of the sockets project at different angles from the body.

8. The connector according to claim 2 wherein a sectional profile of each of the at least two sockets is rectangular.

9. The connector according to claim 2 wherein a sectional profile of each of the at least two sockets is square.

10. The connector according to claim 2 wherein a sectional profile of each of the at least two sockets is circular.

11. The connector according to claim 2 wherein the opening of each of the at least two sockets is tapered.

12. The connector according to claim 2 wherein each rib varies in height along a length thereof.

13. The connector according to claim 2 wherein each of the at least two sockets or the body includes a stopper plate to limit entry of the end of the board into each socket.

14. The connector according to claim 2 wherein each of the at least two sockets or the body includes a stopper ridge to limit entry of the end of the board into each socket.

15. The connector according to claim 2 formed as two or more parts, each part mutually separated at the at least one sheet slot.

16. The connector according to claim 2 wherein the body is formed from a sheet steel material and bent into a fully formed configuration.

17. The connector according to claim 2 further including at least one tool slot extending axially along the wall of each socket to permit a tool to be inserted through the at least one tool slot to engage with the board.

18. A kit of parts including at least two said connectors according to claim 2, said at least one board, and said at least one sheet.

19. The kit according to claim 18 wherein the at least one board includes a longitudinal groove formed therein that corresponds with the sheet slots of the connectors.

* * * * *